United States Patent [19]

Boser

[11] 4,321,880

[45] Mar. 30, 1982

[54] PRESSER FOOT ATTACHMENT

[75] Inventor: Ronald J. Boser, Dix Hills, N.Y.

[73] Assignee: Union Special Corporation, Chicago, Ill.

[21] Appl. No.: 147,986

[22] Filed: May 8, 1980

[51] Int. Cl.[3] ..... D05B 37/00; D05B 35/06

[52] U.S. Cl. ..... 112/127; 112/151; 112/235; 112/262.1

[58] Field of Search ..... 112/127, 151, 235, 260, 112/122, 123, 125, 132, 262.1

[56] References Cited

U.S. PATENT DOCUMENTS

| | | | |
|---|---|---|---|
| 1,177,138 | 3/1916 | Ringe | 112/122 |
| 1,221,252 | 4/1917 | Weis | 112/127 |
| 1,267,621 | 5/1918 | Berger, Jr. | 112/235 |
| 2,331,170 | 10/1943 | Brussel | 112/114 |
| 2,341,686 | 2/1944 | Billington | 112/151 |
| 2,357,749 | 9/1944 | McCann | 112/235 |
| 2,472,862 | 2/1949 | Sigoda | 112/127 |
| 2,475,758 | 7/1949 | Seaman | 112/127 |
| 2,645,193 | 7/1953 | Chinnici | 112/123 |
| 2,893,336 | 7/1959 | Chinnici | 112/132 |
| 2,917,013 | 12/1959 | Burgert | 112/127 |
| 3,054,366 | 9/1962 | Cremer | 112/123 |
| 3,115,854 | 12/1963 | Coletta | 112/151 |
| 3,389,668 | 6/1968 | Marforio | 112/125 |
| 3,577,944 | 5/1971 | Willenbacher et al. | 112/127 |
| 4,018,174 | 4/1977 | DiBenedetto et al. | 112/235 |

FOREIGN PATENT DOCUMENTS

| | | | |
|---|---|---|---|
| 500197 | 6/1930 | Fed. Rep. of Germany | 112/260 |
| 1734908 | 9/1956 | Fed. Rep. of Germany | 112/235 |

*Primary Examiner*—Peter P. Nerbun

*Attorney, Agent, or Firm*—John W. Harbst; John A. Schaerli

[57] ABSTRACT

The present invention is directed to a presser foot attachment adapted for use with a sewing machine for stitching an upper material to a base material and simultaneously trimming the edge of the base material along a line closely adjacent the row of stitches. The presser foot attachment includes a main section and an auxiliary section. The main section of the foot terminates just forward of the sewing machine needle so as to allow the juxtaposed edges of the upper and lower materials to be placed in close proximity to the needle at the onset of the sewing operation. The auxiliary section is movable between two positions and aids in guiding and separating the upper material over the base material and to the sewing station of the machine.

11 Claims, 15 Drawing Figures

FIG. 4
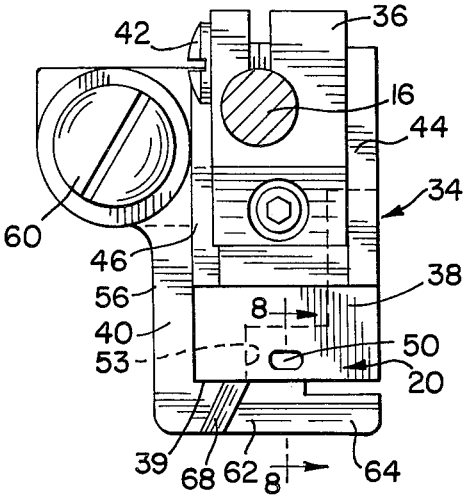
FIG. 5
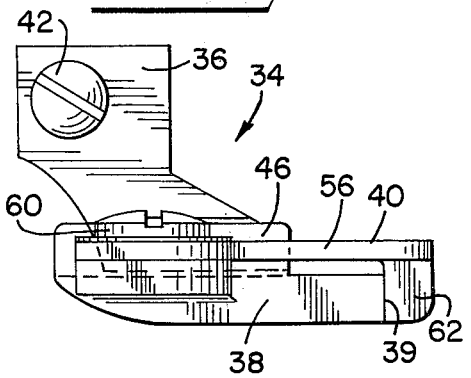
FIG. 6
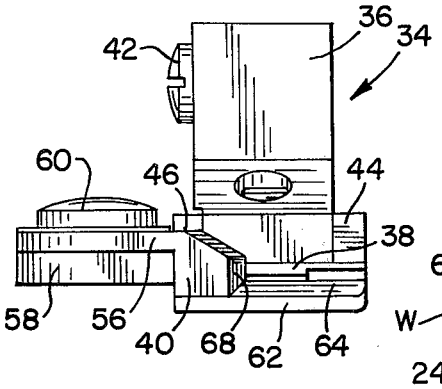
FIG. 7
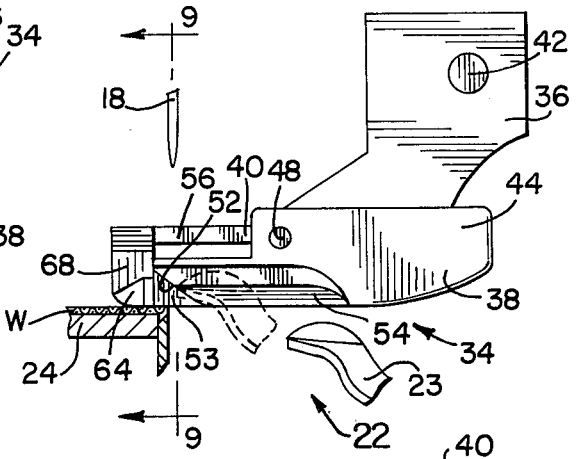
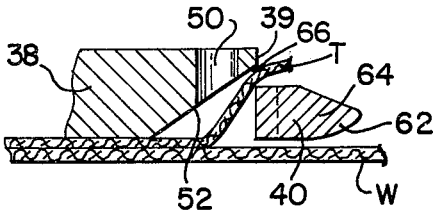
FIG. 8
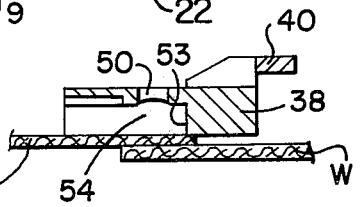
FIG. 9

FIG. 10
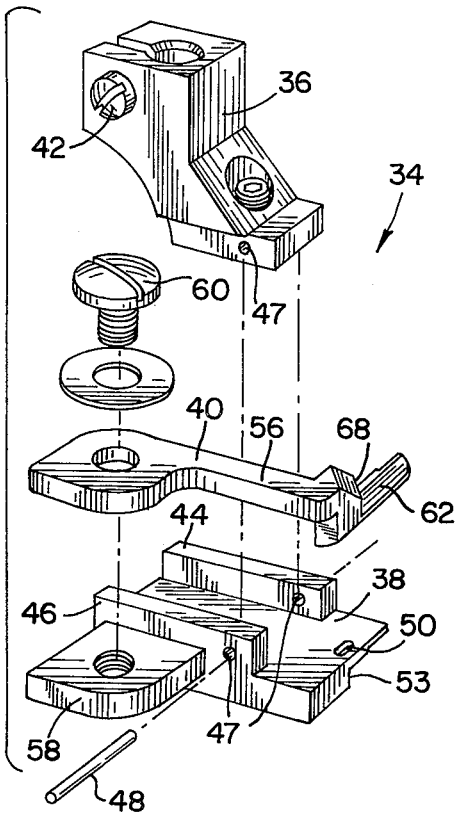
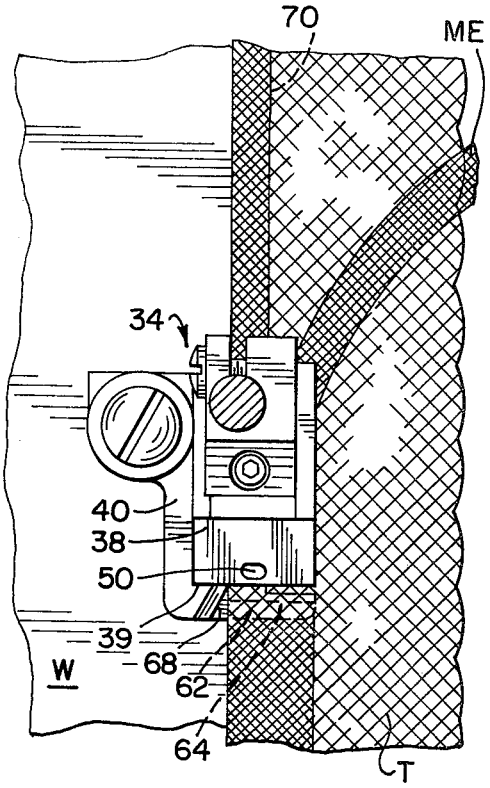
FIG. 12
FIG. 11
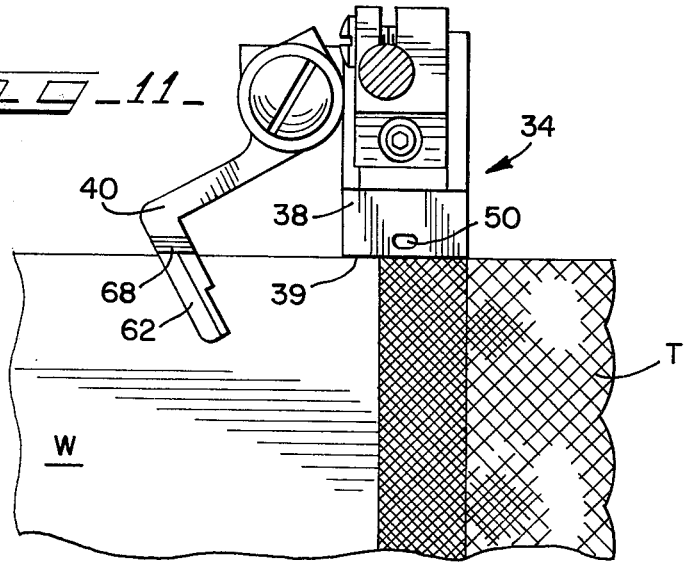

PRESSER FOOT ATTACHMENT

BACKGROUND OF THE INVENTION

The invention relates, in general, to sewing machines and attachments therefore and, more particularly, to a device for stitching tape or the like to a base material and simultaneously trimming the edge of the base material along a line closely adjacent the line of stitches.

The concept of trimming the marginal edge of a lowermost workpiece while attaching a strip of tape or the like is a fairly well developed art. With this operation, the presser foot assembly is usually provided with a finger like extension which is adapted to intervene between the tape and the workpiece so as to assure that the former will not be trimmed or snagged by the action of the undertrimmer. The operation of sewing a tape or the like of premeasured length to a workpiece has given rise to special problems. When sewing a pre-measured length of tape, it is of utmost necessity that the lateral edges of the tape and the workpiece, to which the tape is to be sewn, be perfectly aligned. If the lateral edges are not aligned, an excess or shortage of tape at the starting end will, of course, result in a corresponding equal displacement of tape at the opposite end—an undesirable as well as unacceptable result. With the pressure foot having a finger like extension provided at the front of the foot, placement of the juxtaposed edges in close proximity to the needle is a difficult and time consuming process which usually includes raising the presser foot from its operative position. Without raising the presser foot, the juxtaposed edges have to be started at some point removed from the sewing station. Because the edges are started in a position removed from the path of the needle means, the operator can not be assured that the lateral edges of the tape and workpiece will remain aligned by the time they are fed to the sewing station. Only the skill of the operator will assure an acceptable finished workpiece.

In closed seam operations, such as waistbands or applying tape to a slip bottom, still further problems arise. When nearing the completion of the seam with a standard presser foot, the finger like means interposed between the tape and workpiece abuts the initial starting point of the seam and, thus, the seam is prevented from passing under the presser foot. Thus, the operator needs to reposition the tape and workpiece consuming valuable time in an attempt to finish the closed seam. In closed seam operations, some operators have found it preferable to sew on the tape and then manually trim the lowermost marginal edge. Of course, this added manual operation increases the number of operations needed to be performed on the workpiece and, as a result, increases the amount of time it takes to produce a finished garment thus increasing the cost.

BRIEF DESCRIPTION OF THE PRESENT INVENTION

The present invention eliminates the heretofore known problems associated with sewing a tape or the like to a workpiece. The present invention is employed in combination with a sewing machine that has a modified undertrimmer operable in synchronization with the reciprical movement of the needle. For severing the marginal edge of the base or lowermost workpiece, the undertrimmer has been modified so as to allow inside corners to be sewn and the edge of the underside garment to be severed along a profile reflecting that of the tape or the like being attached.

The presser foot assembly of the present invention is adapted for the purpose of sewing tape or the like to a workpiece. The presser foot includes a main presser foot section and a freely movable auxiliary section. The main presser foot section is detachably mounted to the presser bar of the machine and has been modified such that the front end abruptly terminates just forward of the needle means. By this construction, the operator is able to position the juxtaposed edges of the tape and workpiece to be sewn in very close proximity to the stitching point where at they are secured. By enabling the placement of the workpiece edges in close proximity to the needle means, and in a perfectly aligned relationship relative one another at the very onset of the sewing operation, assures the desired relationship of the edges at the completion of the sewing operation. Mounted to the main presser foot section is the auxiliary section. The auxiliary section, when in its operative position, intervenes between the tape and the lowermost workpiece edge so as to maintain the tape in a removed condition from the path of the undertrimmer. The auxiliary section yields the advantage of improved operative access to the sewing operator in that it may be moved between operative and inoperative positions at the onset of the sewing cycle. Having once aligned and secured the lateral edges of the tape and the workpiece, the auxiliary section may be moved from a non-operative position to a position whereat it is arranged in a confronting relationship with the front edge of the main presser foot section. In this arrangement, the tape is passed over the auxiliary section but under the main presser foot section. About its upper surface, the auxiliary section is provided with a guide that functions to control or laterally position the free edge of the tape with respect to the needle means.

On closed seams, the auxiliary section provides advantages heretofore unknown. The auxiliary section has a very narrow extension which acts as the means for separating the tape and the lowermost workpiece. Because of its narrow construction, a closed seam sewing operation may continue to a point in proximity to the beginning of the seam with no obstructions. Upon being approached by the initial end of the seam, the auxiliary section may be moved to its inoperative position, thus allowing the operator to finish off the closed seam with no further obstructions. This advantage of working on closed seams is also applicable to the securing of appliques to a workpiece. In applying lace appliques, or the like, it may be desirous to remove that area of the lowermost workpiece which is circumscribed by the stitching of the applique. By this invention, the added operation of requiring an operator to manually trim that workpiece area covered by the applique is eliminated, thus saving time and money.

Because the undertrimmer is operative simultaneous with the operation of the machine, it removes the marginal edge of the lowermost workpiece, thus producing a neat finished edge on the bottom or inside of the garment. The added ability of simultaneously trimming the lowermost marginal edge eliminates the need to manually trim that edge and results in a neater, more secure appearance.

The present invention also includes a modified work support for the machine. Because of the modification to the work support means, the operator is allowed greater access to the sewing area thus aiding in aligning the lateral edges of the tape end and the workpiece.

In line with all of the above, it is a primary object of this invention to provide a sewing machine attachment of the above type which is relatively simple in construction, dependable in operation, and is suited for use in connection with industrial sewing machines.

It is a further object of the present invention to provide a mechanism or attachment that is used in combination with the machine for attaching a tape or the like of any prescribed design to a workpiece with the underside edge being finished by trimming excess material during a sewing operation.

Another object of this invention is to provide as an attachment a presser foot which allows a tape or the like to be fastened with a closed seam with a minimum amount of trouble and in a minimum amount of time.

Yet another object of the present invention is the provision of suitable means which allows an applique to be attached to a workpiece while simultaneously removing the material underlying the applique in a neat and finished seam appearance.

BRIEF DESCRIPTION OF THE DRAWINGS

Having in mind the above objects and other attendant advantages that would be evident from an understanding of this disclosure, the invention comprises the devices, combinations and arrangements of parts as illustrated in the presently preferred embodiment of the invention which is hereinafter set forth in detail so as to enable those skilled in the art to readily understand the functions, operation, construction and advantages of it when read in conjunction with the accompanying drawings in which:

FIG. 4 is an enlarged fragmentary plan view showing in detail the presser foot attachment of the present invention;

FIG. 5 is a left-hand side view of the presser foot shown in FIG. 4;

FIG. 6 is a front elevational view of the presser foot assembly shown in FIG. 4;

FIG. 7 is a right-hand elevational view of the presser foot shown in FIG. 4 and also illustrating, schematically, the undertrimmer assembly used in combination with the present invention;

FIG. 8 is an enlarged fragmentary sectional view taken along Line 8—8 of FIG. 4;

FIG. 9 is a sectional view taken along Line 9—9 of FIG. 7;

FIG. 10 is an exploded perspective view of the present invention;

FIG. 11 is a plan view of the present invention showing a portion of the work on which the device is working, the attachment being in an inoperative position;

FIG. 12 is a view similar to FIG. 11 but showing the instant attachment in a different position in relation to the work and showing the attachment in an operative position;

DETAILED DESCRIPTION OF THE PREFERRED EMBODIMENT

Figure 1:
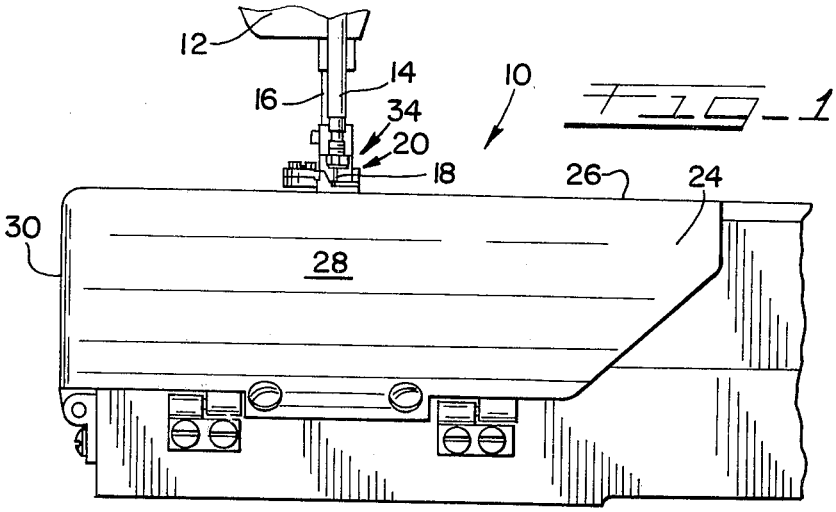
FIG. 1 is a front elevational view of a fragmentary portion of a sewing machine which has been equipped with a presser foot attachment embodying the principles of the present invention.

Referring to the drawings, wherein like reference numerals refer to like parts throughout the several views, only so much of a sewing machine is shown as is deemed necessary to illustrate the application and mode of operation of a presently preferred embodiment of the invention. The machine illustrated and generally designated by reference numeral 10 is of the type manufactured and sold by Union Special Corporation under Style Number 53100R. Suffice it to say that the standard machine 10 includes a head 12 from whence a needle bar 14 and presser bar 16 depend. The needle bar of this machine is capable of both endwise and lateral reciprocation and carries, at its lower end, needle means 18 the general location of which defines a sewing station 20. Cooperating with the needle means in the formation of stitches is a conventional loop taker (not shown) which may be driven in timed relation with the reciprocation of the needle means 18. Also driven in concert with the needle reciprocation is a work feed mechanism means (not shown) which may be of the conventional four motion type. The feed mechanism serves to incrementally move the workpiece W (FIG. 11) through the sewing station 20. As schematically represented in FIG. 7, this particular style machine is provided with a workpiece undertrimmer generally designated 22. The undertrimmer is situated beneath the workpiece support 24 and is arranged to one side of the needle means 18 at a prescribed distance therefrom. The undertrimmer is operated in a conventional manner so as to trim only the lowermost marginal edge in the series of workpieces being sewn. The location of the cutter is selected to allow for the requisite lateral displacement of the needle means in forming zig-zag stitching, and to provide for a sufficient body of material between the cut edge and the adjacent side of the stitching to assure support in the material for the stitching. The undertrimmer 22 is operatively driven from the four motion feed mechanism and, as such, is reciprocated in timed relation to the needle means 18. As schematically represented in FIG. 7, the movable blade 23 of the undertrimmer moves from the solid line position to the dotted line position and then downwardly to trim the lowermost workpiece edge. The tip of the movable blade 23 moves in a generally elliptical like path. Also, it should be noted that the blade 23 has been slightly modified such that during its movement, the tip thereof closely proximates the transverse plane of the needle means which lies perpendicular to the direction of feed.

Figure 2:
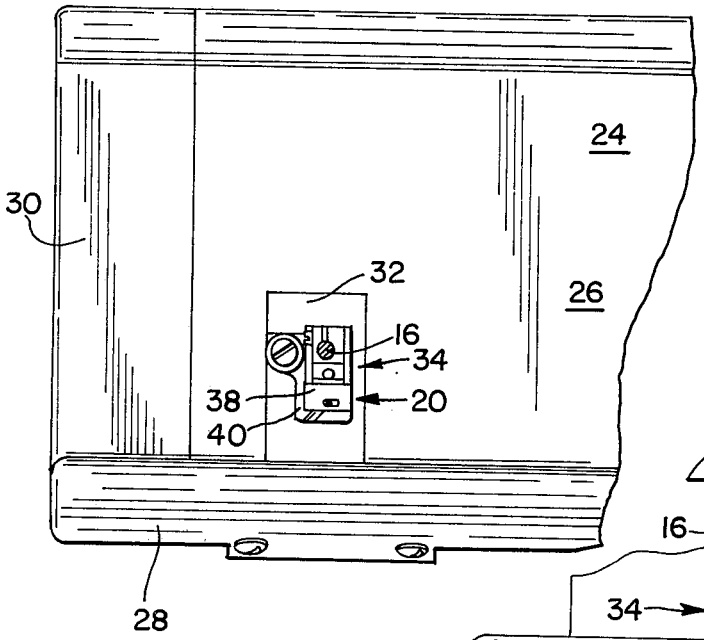
FIG. 2 is a top plan view illustrating the present invention.
Figure 3:
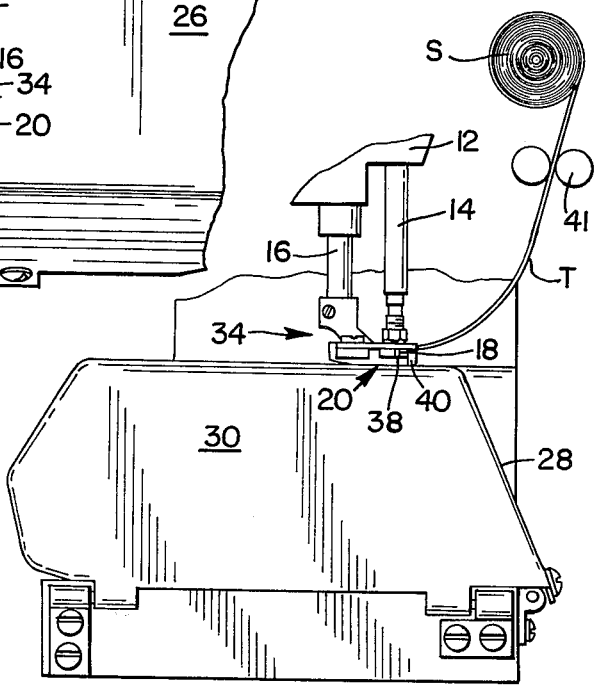
FIG. 3 is a side elevational view of a portion of the machine and the attachment shown in FIG. 1.

In the present invention, the work support means 24 has been altered or modified so as to allow the operator greater access to the sewing station 20. As best seen in FIGS. 1, 2 and 3, the work support 24 is composed of a primary work supporting surface 26 and two complimentary hinged panels 28 and 30. The panels 28 and 30 are mounted such that they may be opened to expose the inner workings of the machine. The primary work supporting surface 26 accommodates a throat plate 32 through which a portion of the feed mechanism projects so as to advance the workpiece. The hinged panel 28 depends in a slanting downward direction away from the forward edge of the throat plate so as to shorten the work support area or distance in front of the needle. This shortened distance in front of the needle allows the operator greater physical and optical access to the sewing station 20. By this construction, the workpieces can be properly and more easily positioned prior to the sewing operation or during the sewing operation in certain circumstances such as sewing appliques. The material to be sewn is held in spring biased relation against the primary work supporting surface by a presser foot attachment connected to the presser bar 16 which is spring biased downwardly by suitable resilient means (not shown) arranged within the machine head 12. It is the purpose of the present invention to provide, as a sewing machine attachment, a novel presser foot assembly which cooperates with the feed mechanism of the machine in advancing the workpieces through the sewing station.

In the presently preferred illustrated embodiment, the presser foot assembly 34 includes a shank portion 36, a main section means 38 connected to the shank, and an auxiliary or guiding section means 40. The shank 36 is suitably adapted such that it may be demountably attached to the distal end of the presser bar 16 through the clamping action of screw 42 or other suitable means. The lower end of the presser foot shank 36 is received by the main section means 38 between the upwardly extending bifurcated sections 44 and 46. Both the bifurcated sections and the lower extremity of the shank 36 are suitably apertured, as at 47, so as to receive a pin 48 thus permitting tilting or pivotal movement of the main and auxiliary sections relative to the shank. The pin 48 may be retained in place by friction or by peening over its ends, after assembly of the parts. As best seen in FIGS. 4, 8 and 10, the main section means 38 of the presser foot assembly is formed with an elongated slot 50 which permits passage and lateral movement of the needle means 18. Unlike most presser foot soles, the main presser foot section 38 abruptly terminates just forward of slot 50. That is, the forward end 39 of the main presser foot section terminates at a distance less than two stitch lengths in front of the needle centerline. As shown in FIG. 8, in the area of the needle slot 50, the underside of the main presser foot section 38 is downwardly and rearwardly slanted as at 52. A generally vertical wall 53 is established by the lateral limits of the slanting surface and serves to aid in positioning the tape or applique during sewing.

As may be best seen in FIGS. 7 and 9, the undersurface of the main presser foot section is provided with a recess 54. The recess 54 is of such character so as to allow the entrance into the same by the movable blade 23 of the undertrimmer assembly 22. By this construction, the movable blade of the undertrimmer assembly is allowed to move over the marginal edge of the lower workpiece W but under the tape or applique T being attached. Thus, on its downward movement, the undertrimmer severs only the lowermost marginal edge of the workpieces being sewn.

The function of the presser foot assembly 34 as described thus far is essentially conventional. The novelty of the present invention resides in the combination with the described structure of an auxiliary section or attachment 40. The auxiliary section 40 is effective to serve two purposes. First, it acts as ply separator which, as best seen in FIG. 8, acts to separate the tape T from the lower workpiece W as the latter is being trimmed. In addition, the auxiliary section acts as a guide for the tape being passed from a supply S (FIG. 3) through suitable tensioning means 41 over the auxiliary section 40 and beneath the main section means 38 to the sewing station 20. The auxiliary attachment 40 is supported by and movable with the main section means 38. It should be noted, however, that the auxiliary section is also independent of the main section means 38 in the sense that it may be moved between operative and inoperative positions at the will of the operator. So as to allow such freedom of movement, the auxiliary section 40 is provided with an arm 56, one end of which may be secured to a platform like projection 58 which extends from the side of the main presser foot section 38. By securing the arm 56 to the platform like projection, the attachment may be moved about a plane parallel to that defined by the main section means. Screw 60 serves to secure the arm 56. Screw 60 provides the pivot point about which the attachment is adapted to swing freely from its inoperative position shown in FIG. 11 to an operative position shown in FIG. 12. The screw, preferably, has a smooth angular shoulder portion directly beneath the head so as to allow free swinging movement of the auxiliary section even when the screw is tightened in place. The attachment 40 is retained in its operative position not only by the friction inherent with the pivot, but also by the frictional drag of the workpiece which passes over a portion of the attachment in a manner to be later described. If desired, however, any suitable detent or spring washer could be used for retaining the attachment in either its operative or inoperative position.

Adjacent the free end of arm 56 and extending laterally therefrom is an extension 62. When the auxiliary attachment is arranged in its operative position, extension 62 is in a confronting relationship with the forward end 39 of the main section means 38 and extends across the entire width thereof. As best seen in FIGS. 4, 5, 7 and 8, the extension 62 is provided with a reduced portion 64 over which the tape T passes. The extension 62 is formed, at its front edge, as narrowly as possible so as to allow the same to intervene between the tape T and the workpiece W as close to the stitching point 20 as possible. As best shown in FIG. 8, the reduced portion 64 is formed such that, when in its operative position, a slot 66 is formed between the upper extremity of the reduced portion 64 and the front edge 39 of the main section means 38. It is through this slot 66 that the tape is allowed to pass from a position over the auxiliary section to a position under the main section means 38. On its upper surface, the extension is provided with an angled surface 68 which serves as a guide for the tape or applique to be sewn. As especially obvious from FIG. 4, when the attachment 40 is arranged in its operative position, the rearward extremity of the guide edge 68, in the direction of feed, is in positional agreement with the vertical wall 53 formed on the main section means 38. By this construction, the lateral displacement of the tape or the like being sewn may be controlled to one side of the needle means 18.

Figure 13:
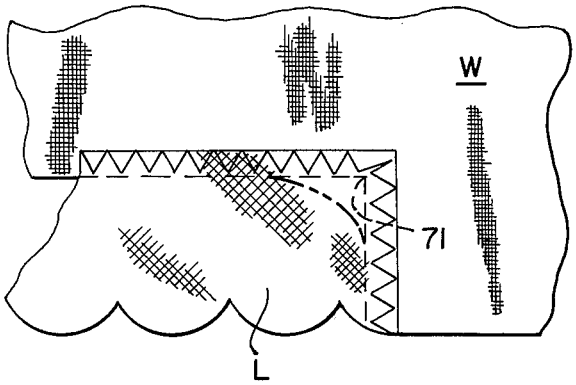
FIG. 13 illustrates a workpiece having an inside corner to which a premeasured length of tape or the like is to be applied.

What follows now is a description of a typical operation in connection with which the invention may appropriately be used; i.e. sewing plain or lace tape to lingerie, blouses, curtains, etc. After aligning the lateral edges of the work piece and tape to be sewn, and with the guide attachment 40 in its inoperative position as shown in FIG. 11, the operator positions the aligned edges at the front of the main presser foot section 38. Even at this very early operational stage, the present invention yields superior advantages to the operator. That is, the slanted work support 24 having such a shortened distance in front of the needle means 18, allows the operator greater optical and physical access to the sewing station 20 thus enabling the proper positioning of the juxtaposed edges. The abrupt termination of the main presser foot section 38 at a point just forward of the needle's path, allows the operator to place the juxtaposed edges in immediate proximity to the needle means 18 thus assuring proper edge alignment. With the present invention, proper placement of the juxtaposed edges is achieved without raising the presser foot assembly 34 from its operative position thus eliminating the timely step of having to raise the presser foot so as to position the edge in close proximity to the needle. The ability to position the juxtaposed edges in the immediate proximity of the needle further assures that the edges travel a brief distance, i.e. less than two stitch lengths, before they are fastened by the first in a series of stitches. As mentioned above, in instances where a premeasured strip is being sewn, the proper edge alignment at the onset of the sewing operation is most important so as to assure proper positioning or alignment of the tape or the like at the other end thereof. Having once applied a sufficient number of stitches to the workpiece, the auxiliary section means may be moved into its operative position as shown in FIG. 12. When in its operative position, the guide section, and more particularly the reduced portion 64 of the guide section, intervenes between the tape or lace strip being sewn and the workpiece. That is, the lace strip which is to be attached passes over the reduced portion and through the slot 66 to the sewing station. By causing the tape to move over the extension 62 the tape is directed over the cutting action of the undertrimmer 22. On the other hand, the lower workpiece passes under the cutting action of the knife 23 and the marginal edge ME thereof is trimmed from a position rearward of the needle and up to the point lying in the transverse plane of the needle or slightly rearward thereof. The trimmed marginal edge is, of course, waste and is discarded to leave the workpiece and tape joined together along their edge with a finished cut edge 70 on the lowermost workpiece. As the sewing progresses, the tape is guided by the guide 68 arranged on the extension 62 such that the tape is laterally positioned a set distance from the trimmed edge of the workpiece.

Where it is necessary to sew a lace strip or the like L to a workpiece W having an inside corner, represented generally by 71 in FIG. 13, the present invention offers a superior advantage. On operations where a premeasured strip of lace or the like is to be attached to a garment, the lace must be positioned correctly at the onset to ensure no corresponding overlap or shortage at the opposite end thereof. As mentioned above, the shortened distance in front of the sewing area allows the operator greater access to the sewing area and, thus, enables proper positioning of the juxtaposed edges relative to the needle means. Additionally, with the auxiliary attachment 40 in its removed position, the operator is allowed greater access to the needle area. The abrupt termination of the main section means 38 assures that the lace can be positioned properly with respect to the workpiece to which it is to be attached. Moreover, the above mentioned modification to the undertrimmer assembly allows the sharp corner 71 to be formed. If the trimmer should, as on a standard 51300R machine, sever the edge only to a point rearward of the transverse plane of the needle, then a sharp inside corner would not be formed. Instead, the edge of the lowermost workpiece would be formed with a radius like corner as shown in phantom lines in FIG. 13. Having such a radius type edge of the lowermost workpiece show through the lace is undesirable and, as such, produces a non-acceptable garment. The modification of the undertrimmer assembly overcomes this problem and allows sharp inside corners to be formed with no difficulty. Having once positioned the lace relative to the workpiece, a few stitches may be formed so as to secure same. After having secured one end of the lace to the workpiece, the guide attachment is moved into place and the remainder of the strip is simultaneously sewn and guided.

In closed seam operations, such as where tape or the like is to be sewn around the bottom of a woman's slip, the present invention offers special benefits. As with the other operations mentioned above, the auxiliary section allows the operator to position the tape and workpiece perfectly even at the beginning of the seam. After the tape has been adequately secured, the auxiliary section is positioned such that the tape is guided to the stitch forming area. Also, upon completion of the closed seam, the present invention offer benefits heretofore unknown. Without a movable auxiliary section, the operator is prevented from completing the sewing operation because that section of the presser foot intervening between the tape and the workpiece obstructs the movement near the completion of the workpiece and tape of the sewing operation. With the present invention, when nearing the beginning of the seam, the auxiliary section is merely removed from its operative position and the closed seam operation can be completed. Because the auxiliary section is of such narrow width, when it is necessary to move the guide section away, the operation is but two or three stitches from completion. Thus, no further guiding of the strip is demanded and the seam may be completed with only the main section holding the materials to be secured.

Figure 14:
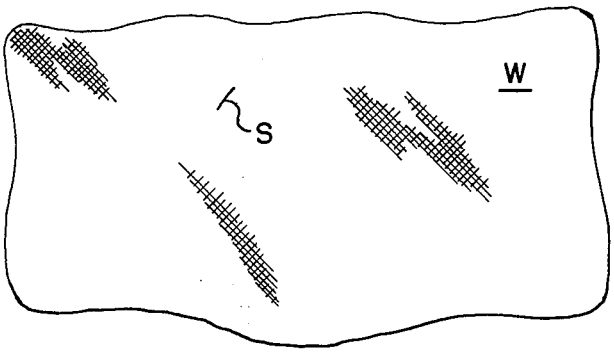
FIG. 14 illustrates a workpiece to which an applique or the like is to be applied.
Figure 15:
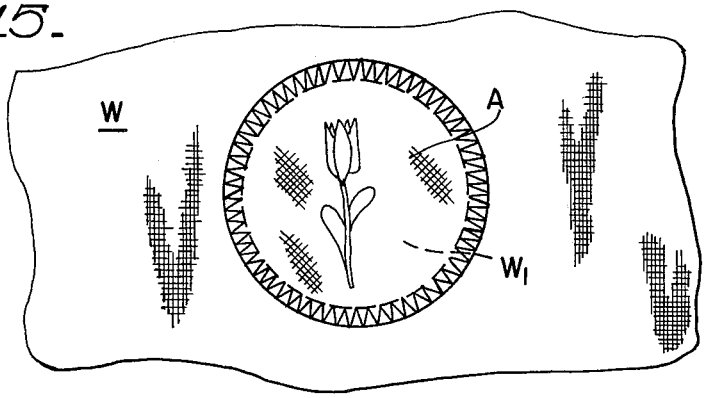
FIG. 15 illustrates a workpiece having an applique or the like stitched thereon by a zig-zag stitch, the dash lines illustrating how the body or the lowermost material is cut out from under the same.

Turning to FIGS. 14 and 15, the present invention has the capability of eliminating required steps in sewing appliques A to the workpieces W. In such operations, the material W1 under the applique is preferably removed. This has previously required the operator to first, sew on the applique, and then subsequently manually trim the material under the applique. This is, of course, time consuming and, thus, a costly process. The present invention totally eliminates the required second manual step. As shown in FIG. 14, with the present invention, the operator will first make a small slit S in the workpiece where the applique is to be attached. With the guiding section in its removed position, and the main section of foot raised, the slit S is placed over the undertrimmer knife and the foot is lowered. The applique can be attached by a few stitches before the auxiliary section is moved into its operative position. The sewing of the applique commences until the sewing operation has returned to its initial starting point. Near the end of the closed seam, the auxiliary section is again removed to its non-operative position and the sewing operation may be completed. Of course, while the applique is being sewn, the material W1 beneath the applique is being simultaneously trimmed. With the instant invention, the applique is sewn and the garment cut-out all in one simple and efficient operation.

Numerous alterations of the structures herein disclosed will suggest themselves for those skilled in the art. It is to be understood that this disclosure relates to but a preferred embodiment of the invention which is for purposes of illustration only and not to be construed as the limitation of the invention. All such modifications which do not depart from the spirit of the invention are intended to be included within the scope of the appended claims.

What is claimed:

1. In a sewing machine for sewing tape to a closed tubular workpiece, the combination of feed mechanism means for moving the tape and workpiece past a sewing station defined by the reciprocal path of a needle whereat the tape and workpiece are secured along a seam, means for supporting the workpiece and tape, cutter means disposed beneath the work support means and operable to sever the marginal edge of only the lower most workpiece edge, and a presser foot assembly comprising:

main section means having an aperture formed therein for allowing passage of the needle therethrough, said main section means having a front edge terminating just forward of said aperture; and auxiliary section means carried by said main section means but arranged for movement freely into either operative or non-operative positions at will during the formation of a seam, said auxiliary section having an extension arranged, when in its operative position, to extend across the entire front edge of said main section means for separating the tape from said workpiece while the lower most marginal edge of the workpiece is being trimmed.

2. In combination with a machine for securing an upper material to a base material along a seam, means for forming a seam in said material, cutter means for trimming the edge of the base material a uniform distance from said seam, said cutter means operating simultaneously with the formation of said seam, and a presser foot assembly comprising:

main section means having a forward end terminating just forward of the point of seam formation, said main section means further including guide means formed along the undersurface of said main section means in the area of stitch formation for controlling the lateral displacement of said upper material as it moves toward the point of seam formation; and movably mounted auxiliary section means including an extension for separating said materials to allow for the trimming of the base material edge, said extension having formed along its upper surface a guide which, when in its operative position, is arranged in positional agreement with said guide means on said main section means.

3. In combination with a machine for securing an upper material to a base material along a seam, a work support means, and undertrimmer for simultaneously trimming the edge of the base material a uniform distance from said seam, and a presser foot assembly comprising:

main section means adapted to resiliently urge both materials against said work support means;

auxiliary section means adapted to intervene between said upper material and said base material whereby separating same to allow for trimming of the base material edge while simultaneously guiding said upper material to the point of seam formation; and said auxiliary section means being mounted so that it may be freely moved at will in a distance lateral to the direction of seam formation.

4. In a sewing machine for securing a tape to a workpiece, the combination of feed mechanism means for moving the tape and workpiece, stitching mechanism means including needle means for securing together the tape and workpiece, cutter means located in proximity to the needle means for trimming only a portion of the underply of material and a presser foot assembly comprising:

main section means having an aperture suitably apertured to allow for passage of the needle means therethrough, said main section means terminating at its forward end, just forward of said aperture; and movably mounted auxiliary section means having an extension for separating the tape and workpiece such that the tape passes over and is laterally guided by the extension to the needle means in the area of the cutter means.

5. In a sewing machine adapted to secure a tape to a workpiece, the combination of stitch forming mechanism means including needle means for securing together the tape and workpiece, work support means for supporting the tape and workpiece, cutter means located in proximity to the needle for severing only a portion of the underply material and a presser foot assembly comprising:

main section means suitably apertured to allow for passage of the needle therethrough, said main section means terminating at its forward end, in the direction of feed, just forward of said aperture; and auxiliary section means pivotally secured to said main section means and including an extension adapted to separate the tape and workpiece such that the tape passes over the workpiece to allow for severance of the workpiece edge while allowing the tape to be laterally guided to the needle means.

6. A sewing machine for securing a tape to a workpiece comprising:

stitch forming instrumentalities including needle means the reciprocal path of which defines a sewing station;

work support means including throat plate means; an undertrimmer assembly located beneath the work support means in proximity to the needle for trimming the marginal edge of the workpiece simultaneously with advancement of same through the sewing station, said undertrimmer assembly including a movable blade which sweeps out a path the foremost parameter of which closely proximates the transverse plane of the needle means;

presser foot assembly means including main section means and an auxiliary section means adapted for movement between operative and non-operative positions, said auxiliary section means having an extension adapted when in its operative position, to seperate the workpiece from the tape to allow for the severance of the workpiece edge and serve to laterally guide the free edge of the tape to the sewing station.

7. The sewing machine defined in claim 6 wherein said work support means includes a primary work supporting surface and at least one hinged panel which depends in a downward slanting direction beginning at a point proximate to the needle means.

8. The sewing machine as defined in claim 6 wherein said auxiliary section means includes an arm which is pivotally secured at one extremity to the main section means of the foot and allows free movement of said extension about a plane parallel to that defined by the main section means.

9. A method of sewing a premeasured length of tape to a workpiece comprising the steps of:

positioning the superimposed juxtaposed lateral edges of the tape and workpiece at a location arranged immediately adjacent the path of a sewing machine needle means while maintaining the machine's presser foot in its operative position;

subsequently separating the tape from the workpiece after the sewing operation has been commenced whereby allowing severance of a marginal edge of the workpiece while concurrently guiding the free edge of the tape with respect to the needle means of the machine.

10. A method of sewing a tape to a workpiece with a closed seam comprising the steps of:

advancing the initial edge of the tape and the workpiece under a presser foot assembly and through the sewing station of a sewing machine in unison;

moving a separator means to an operative position whereat it seperates the tape and workpiece following commencement of the sewing operation to allow for severance of the workpiece edge while concurrently guiding the free edge of the tape with respect to the sewing station of the machine as the workpiece and tape are advanced therethrough;

retracting the separator means from its operative position when the initial edge of the sewn tape and workpiece proximates the sewing station so as to allow completion of the sewing operation with the presser foot remaining in its normal operative position.

11. A method of sewing an applique to a workpiece comprising the steps of:

positioning a slit in said workpiece over the undertrimmer mechanism of a sewing machine having a needle means defining a sewing station and a presser foot assembly;

positioning the applique over said workpiece slit and under said presser foot assembly;

moving a separator means to an operative position whereat it seperates the edge of the applique from the workpiece following commencement of the sewing operation whereby allowing the undertrimmer mechanism to operate on the workpiece underlying the applique while simultaneously providing guidance for the edge of the applique as it and the workpiece are advanced through the machine;

simultaneously trimming the underlying part of the workpiece circumscribed by the line of stitching applied to the applique;

retracting the seperator means from its operative position when the initial portion of the seam in the applique proximate the sewing station.

* * * * *